US010914123B2

(12) United States Patent
Russell et al.

(10) Patent No.: US 10,914,123 B2
(45) Date of Patent: Feb. 9, 2021

(54) EARTH BORING TOOLS WITH POCKETS HAVING CUTTING ELEMENTS DISPOSED THEREIN TRAILING ROTATIONALLY LEADING FACES OF BLADES AND RELATED METHODS

(71) Applicant: Baker Hughes Holdings LLC, Houston, TX (US)

(72) Inventors: Steven Craig Russell, Sugar Land, TX (US); William Schoen, Spring, TX (US); David Gavia, The Woodlands, TX (US)

(73) Assignee: Baker Hughes Holdings, LLC, Houston, TX (US)

( * ) Notice: Subject to any disclaimer, the term of this patent is extended or adjusted under 35 U.S.C. 154(b) by 0 days.

(21) Appl. No.: 16/381,457

(22) Filed: Apr. 11, 2019

(65) Prior Publication Data

US 2019/0316420 A1 Oct. 17, 2019

Related U.S. Application Data

(60) Provisional application No. 62/656,096, filed on Apr. 11, 2018.

(51) Int. Cl.
*E21B 10/43* (2006.01)
*E21B 10/60* (2006.01)

(52) U.S. Cl.
CPC ..... *E21B 10/43* (2013.01); *E21B 10/602* (2013.01)

(58) Field of Classification Search
CPC ..... E21B 10/42; E21B 10/43; E21B 10/54
(Continued)

(56) References Cited

U.S. PATENT DOCUMENTS 2,999,541 A * 9/1961 Kinzbach ..... E21B 10/602 166/55.7
4,351,401 A 9/1982 Fielder
(Continued)

FOREIGN PATENT DOCUMENTS

CA 2952937 A1 12/2015
CN 107431501 A 12/2017
(Continued)

OTHER PUBLICATIONS

Craig et al., U.S. Appl. No. 16/286,922 titled Earth-Boring Tools Having Pockets Trailing Rotationally Leading Faces of Blades and Having Cutting Elements Disposed Therein and Related Methods, filed Feb. 27, 2019.

(Continued)

*Primary Examiner* — Kenneth L Thompson
(74) *Attorney, Agent, or Firm* — TraskBritt

(57) ABSTRACT

An earth-boring tool may include a plurality of blades extending axially and radially from a body. A first plurality of cutting elements may be disposed along rotationally leading faces of the plurality of blades. A pocket may be formed within a blade, and the pocket may extend angularly into the blade from a rotationally leading face of the blade within a shoulder region of the blade. A second plurality of cutting elements may be disposed within the at least one pocket. A rotational pathway of at least one cutting element of the second plurality of cutting elements may at least partially overlaps with another rotational pathway of at least one cutting element of the first plurality of cutting elements.

20 Claims, 8 Drawing Sheets

(58) Field of Classification Search
USPC ..... 175/396, 397, 398, 421
See application file for complete search history.

(56) References Cited

U.S. PATENT DOCUMENTS

| | | | | |
|---|---|---|---|---|
| 4,499,958 | A * | 2/1985 | Radtke | E21B 10/55 175/428 |
| 4,714,120 | A | 12/1987 | King | |
| 4,723,612 | A | 2/1988 | Hicks | |
| 4,907,662 | A * | 3/1990 | Deane | E21B 10/43 175/431 |
| 5,103,922 | A * | 4/1992 | Jones | E21B 10/55 175/421 |
| 5,186,268 | A | 2/1993 | Clegg | |
| 5,244,039 | A | 9/1993 | Newton et al. | |
| 6,062,325 | A | 5/2000 | Taylor et al. | |
| 6,808,031 | B2 | 10/2004 | Mensa-Wilmot et al. | |
| 8,881,848 | B2 | 11/2014 | Knull et al. | |
| 9,279,294 | B1 | 3/2016 | Cooley et al. | |
| 9,359,825 | B2 | 6/2016 | Gavia et al. | |
| 9,869,133 | B2 | 1/2018 | Chen et al. | |
| 10,662,714 | B2 * | 5/2020 | Cunningham | E21B 10/08 |
| 2005/0080595 | A1 | 4/2005 | Huang | |
| 2007/0102202 | A1 | 5/2007 | Choe et al. | |
| 2007/0205024 | A1 * | 9/2007 | Mensa-Wilmot | E21B 10/54 175/408 |
| 2008/0179108 | A1 | 7/2008 | McClain et al. | |
| 2008/0302575 | A1 | 12/2008 | Durairajan et al. | |
| 2009/0301786 | A1 | 12/2009 | Smith et al. | |
| 2010/0252332 | A1 | 10/2010 | Jones et al. | |
| 2011/0100724 | A1 | 5/2011 | Azar | |
| 2011/0192651 | A1 | 8/2011 | Lyons et al. | |
| 2012/0090900 | A1 | 4/2012 | Prajapati et al. | |
| 2012/0205163 | A1 | 8/2012 | Azar et al. | |
| 2013/0153305 | A1 | 6/2013 | Chrest | |
| 2013/0292185 | A1 | 11/2013 | Knull et al. | |
| 2014/0131118 | A1 | 5/2014 | Chen et al. | |
| 2016/0084010 | A1 | 3/2016 | Beaton et al. | |
| 2019/0271194 | A1 * | 9/2019 | Russell | E21B 10/602 |

FOREIGN PATENT DOCUMENTS

| | | | |
|---|---|---|---|
| EP | 3280057 | A1 | 2/2018 |
| KR | 10-2017-0132178 | A | 12/2017 |
| SU | 378618 | A1 | 4/1973 |

OTHER PUBLICATIONS

International Search Report for International Application No. PCT/US2019/026942 dated Aug. 2, 2019, 4 pages.

International Written Opinion for International Application No. PCT/US2019/026942 dated Aug. 2, 2019, 7 pages.

International Written Opinion for International Application No. PCT/US2019/026942 dated Aug. 8, 2019, 7 pages.

International Search Report for International Application No. PCT/US2019/019735 dated Jun. 14, 2019, 4 pages.

International Written Opinion for International Application No. PCT/US2019/019735 dated Jun. 14, 2019, 6 pages.

* cited by examiner

EARTH BORING TOOLS WITH POCKETS HAVING CUTTING ELEMENTS DISPOSED THEREIN TRAILING ROTATIONALLY LEADING FACES OF BLADES AND RELATED METHODS

CROSS-REFERENCE TO RELATED APPLICATION

This application claims the benefit under 35 U.S.C. § 119(e) of U.S. Provisional Patent Application Ser. No. 62/656,096, filed Apr. 11, 2018, the disclosure of which is hereby incorporated herein in its entirety by this reference.

TECHNICAL FIELD

This disclosure relates generally to earth-boring tools having pockets defined in one or more blades of the earth-boring tools. More specifically, this disclosure relates to earth-boring tools wherein cutting elements are at least partially located in the pockets.

BACKGROUND

Oil wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and\or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include earth-boring tools. The earth-boring tools may include a body including a plurality of blades. Each blade of the plurality of blades may extend axially and radially relative to a center longitudinal axis of the body. At least one blade of the plurality of blades may have a pocket extending into the at least one blade from a rotationally leading face of the at least one blade in at least a shoulder region of the at least one blade. The pocket may include an at least substantially planar back surface forming an obtuse angle with the leading face of the at least one blade, a side surface extending from the rotationally leading face of the at least one blade to the back surface, and a lower surface extending from the rotationally leading face of the at least one blade to the back surface. A first plurality of cutting elements may be secured along rotationally leading faces of the plurality of blades, and a second plurality of cutting elements may be secured to the at least one blade of the plurality of blades proximate a back surface of the at least one pocket.

In additional embodiments, the earth-boring tool may include a body including a plurality of blades. Each blade of the plurality of blades may extend axially and radially relative to a center longitudinal axis of the body. At least one blade of the plurality of blades may have a pocket extending into the at least one blade from a rotationally leading face of the at least one blade in a shoulder region and gage region of the at least one blade, wherein between about 40% and about 80% of a height of the pocket is formed within the gage region of the at least one blade. A first plurality of cutting elements may be secured along rotationally leading faces of the plurality of blades; and a second plurality of cutting elements may be secured to the at least one blade of the plurality of blades proximate a back surface of the at least one pocket.

Some embodiments of the present disclosure include a method of forming an earth-boring tool. The method may include forming a body of an earth-boring tool including a plurality of blades; forming at least one pocket within a shoulder region and a gage region of at least one blade of the plurality of blades, comprising: forming an at least substantially planar back surface of the at least one pocket, the at least substantially planar back surface forming an obtuse angle with a leading face of the at least one blade; forming a side surface of the at least one pocket to extend from the rotationally leading face of the at least one blade to the back surface of the at least one pocket; and forming a lower surface of the at least one pocket to extend from the rotationally leading face of the at least one blade to the back surface of the at least one pocket; wherein between about 40% and about 80% of a height of the at least one pocket is formed within the gage region of the at least one blade, securing a first plurality of cutting elements along rotationally leading faces of the plurality of blades; and securing a second plurality of cutting elements to the at least one blade proximate a back surface of the at least one pocket.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
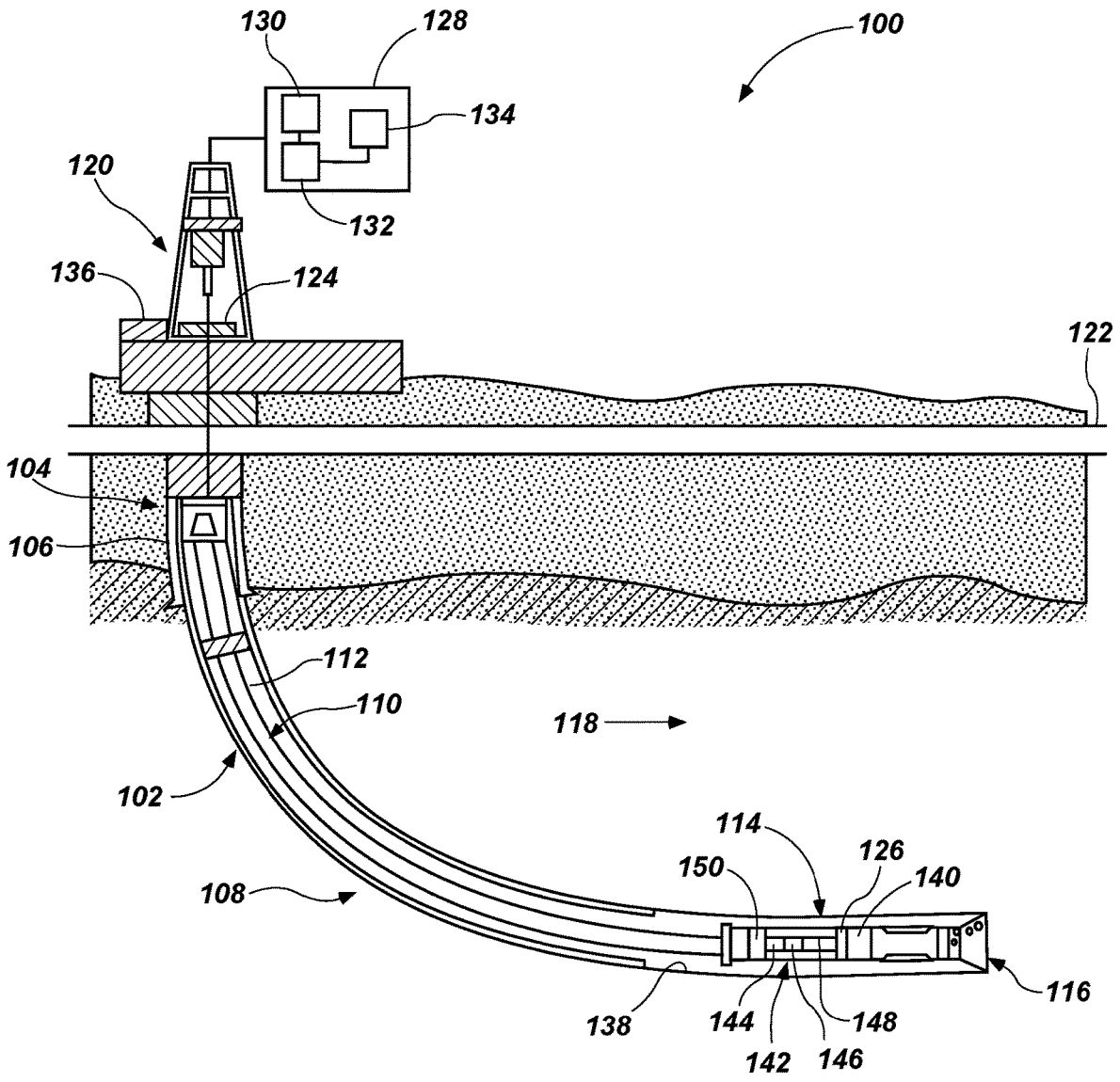
FIG. 1 is a schematic diagram of a wellbore system comprising a drill string that includes an earth-boring tool according to one or more embodiments of the present disclosure.

The illustrations presented herein are not actual views of any drill bit or any component thereof, but are merely idealized representations, which are employed to describe embodiments of the present invention.

As used herein, the terms "earth-boring tool" mean and include earth-boring tools for forming, enlarging, or forming and enlarging a borehole. Non-limiting examples of bits include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (roller cones).

As used herein, the term "cutting structure" means and includes any element or feature that is configured for use on an earth-boring tool and for removing formation material from the formation within a wellbore during operation of the earth-boring tool.

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to a body of an earth-boring tool.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "cutting profile" refers to a two-dimensional representation of the profile of the cutting elements of the earth-boring tool that is defined by rotating all cutting elements of the earth-boring tool about a central longitudinal axis of the earth-boring tool and into a common plane on one half of the body of the tool.

As used herein, the term "cutting profile height" refers to an axial length (e.g., a length along an axial length of the earth-boring tool) between a bottom of a nose region of the body of the earth-boring tool and a bottom of a gage region (i.e., an interface of a shoulder region and the gage region) of the blade 214.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing, for example. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2A:
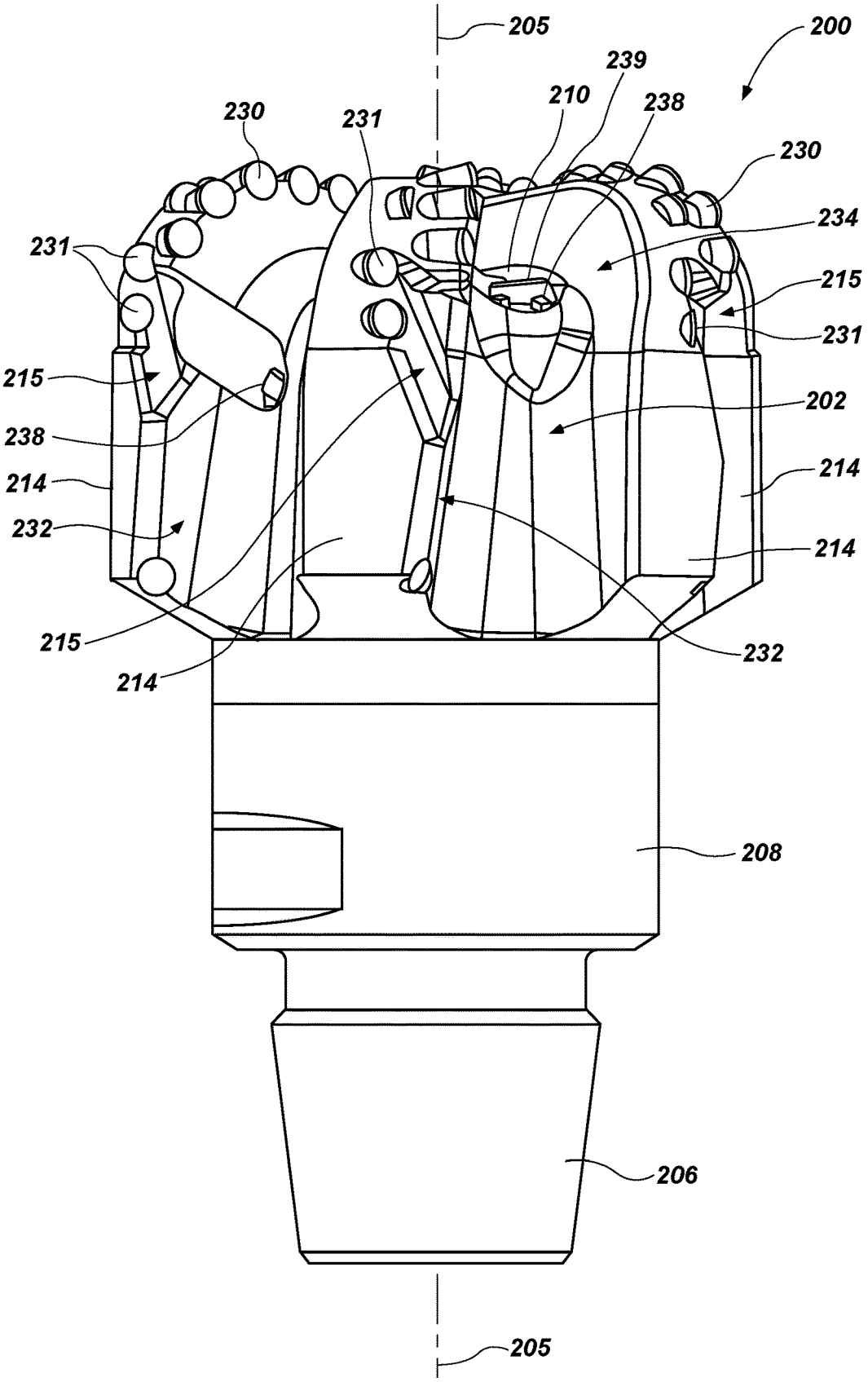
FIG. 2A is a side perspective view of an earth-boring tool according to one or more embodiments of the present disclosure.
Figure 2B:
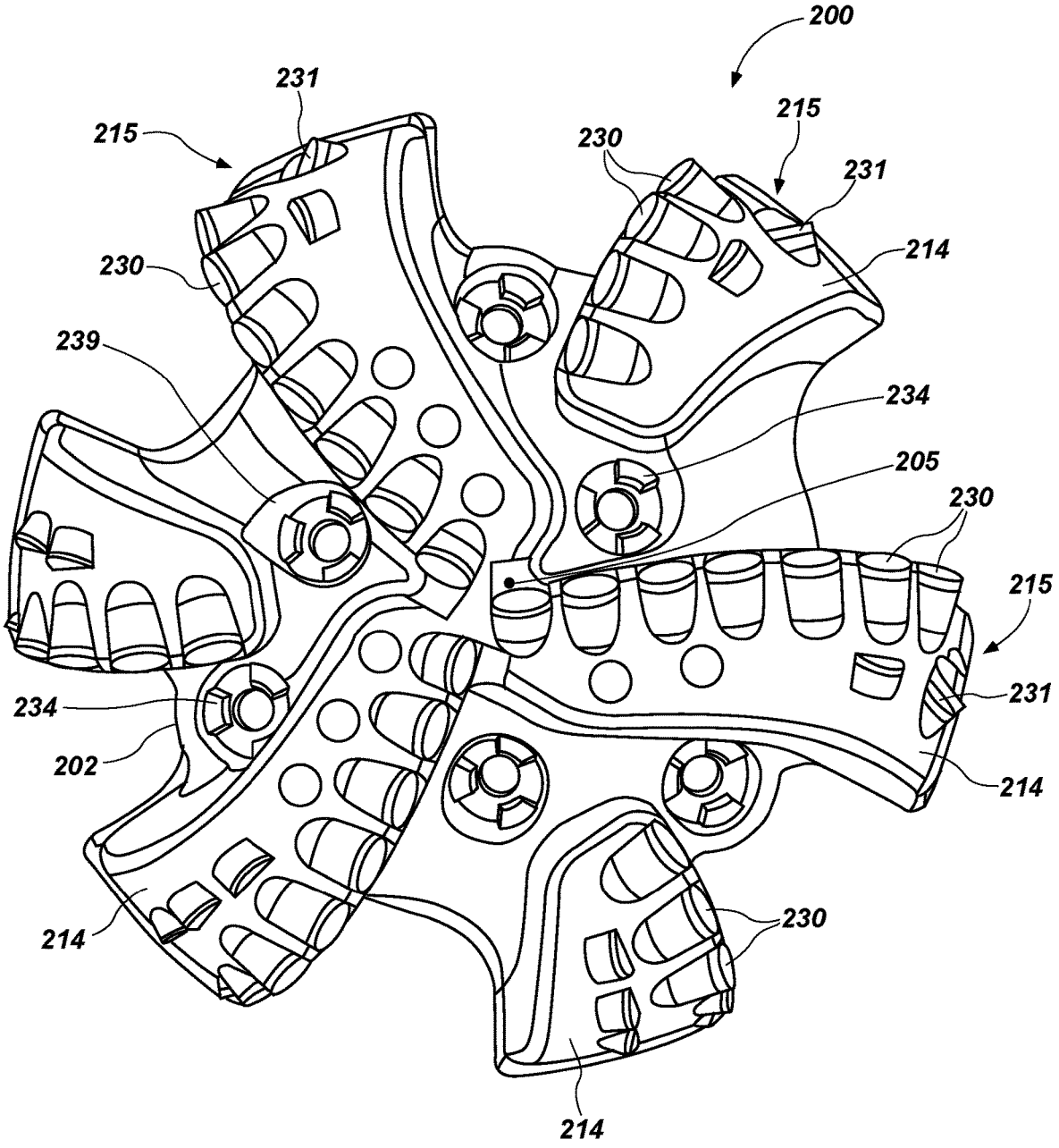
FIG. 2B is a bottom view of an earth-boring tool according to one or more embodiments of the present disclosure.

FIG. 2A is a side view of an earth-boring tool 200 that may be used with the drilling assembly 114 of FIG. 1 according to one or more embodiments of the present disclosure. FIG. 2B is a bottom view of the earth-boring tool 200 of FIG. 2A. Referring to FIGS. 2A and 2B together, in some embodiments, the earth-boring tool 200 may include a drill bit having a plurality of blades 214. In additional embodiments the earth-boring tool 200 may include a drill bit having at least one rotatable cutting structure in the form of a roller cone and a plurality of blades 214. For example, the earth-boring tool 200 may be a hybrid bit (e.g., a drill bit having both roller cones and blades 214). Furthermore, the earth-boring tool 200 may include any other suitable drill bit or earth-boring tool 200 having rotatable cutting structures and/or blades 214 for use in drilling and/or enlarging a borehole 102 in a formation 118 (FIG. 1).

The earth-boring tool 200 may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of blades 214.

Each blade 214 of the plurality of blades 214 of the earth-boring tool 200 may include a first plurality of cutting elements 230 fixed thereto. The first plurality of cutting elements 230 of each blade 214 may be located in a row along a profile of the blade 214 proximate a rotationally leading face 232 of the blade 214. In some embodiments, the first plurality of cutting elements 230 of the plurality of blades 214 may include PDC cutting elements 230. Moreover, the first plurality of cutting elements 230 of the plurality of blades 214 may include any suitable cutting element configurations and materials for drilling and/or enlarging boreholes.

The plurality of blades 214 may extend from the end of the body 202 opposite the neck 206 and may extend in both the axial and radial directions. Each blade 214 may have multiple profile regions as known in the art (cone, nose, shoulder, gage).

Fluid courses 234 may be formed between adjacent blades 214 of the plurality of blades 214 and may be provided with drilling fluid by ports 239 located at the end of passages leading from an internal fluid plenum extending through the body 202 from a tubular shank 208 at the upper end of the earth-boring tool 200. Nozzles 238 may be secured within the ports 239 for enhancing direction of fluid flow and controlling flow rate of the drilling fluid. The fluid courses 234 extend to junk slots 240 extending axially along the longitudinal side of earth-boring tool 200 between blades 214 of the plurality of blades 214.

As will be discussed in greater detail below in regard to FIG. 3, at least one blade 214 of the plurality of blades 214 may include a pocket 215 formed in the at least one blade 214 at least partially within a shoulder region of the at least one blade 214. The pocket 215 may house a second plurality of cutting elements 231. Furthermore, in one or more embodiments, one or more cutting elements of the second plurality of cutting elements 231 may trail (e.g., trail in a rotational direction of the earth-boring tool 200) one or more cutting elements of the first plurality of cutting element 230 disposed at the rotationally leading face 232 of the blade 214. For instance, within a cutting profile of the earth-boring tool 200 defined by the first plurality of cutting elements 230 disposed at the rotationally leading face 232 of the blade 214 and the second plurality of cutting elements 231 housed by the pocket 215 formed in the at least one blade 214, at least one cutting element 231 of the second plurality of cutting elements 231 may at least partially overlap with a cutting element of the first plurality of cutting elements 230 of the at least one blade 214. For example, in some embodiments, between about 60% and about 100% of a single cutter profile of the at least one cutting element 231 of the second plurality of cutting elements 231 may overlap with a cutter profile of a cutting element of the first plurality of cutting elements 230 of the at least one blade 214. In some embodiments, between about 80% and about 100% of a single cutter profile of the at least one cutting element 231 of the second plurality of cutting elements 231 may overlap with a cutter profile of a cutting element of the first plurality of cutting elements 230 of the at least one blade 214. In further embodiments, between about 90% and about 100% of a single cutter profile of the at least one cutting element 231 of the second plurality of cutting elements 231 may overlap with a cutter profile of a cutting element of the first plurality of cutting elements 230 of the at least one blade 214. In yet further embodiments, between about 95% and about 100% of a single cutter profile of the at least one cutting element 231 of the second plurality of cutting elements 231 may overlap with a cutter profile of a cutting element of the first plurality of cutting elements 230 of the at least one blade 214. The pocket 215 and second plurality of cutting elements 230, 231 are described in greater detail in regard to FIGS. 3A, 3B, and 6.

Figure 3A:
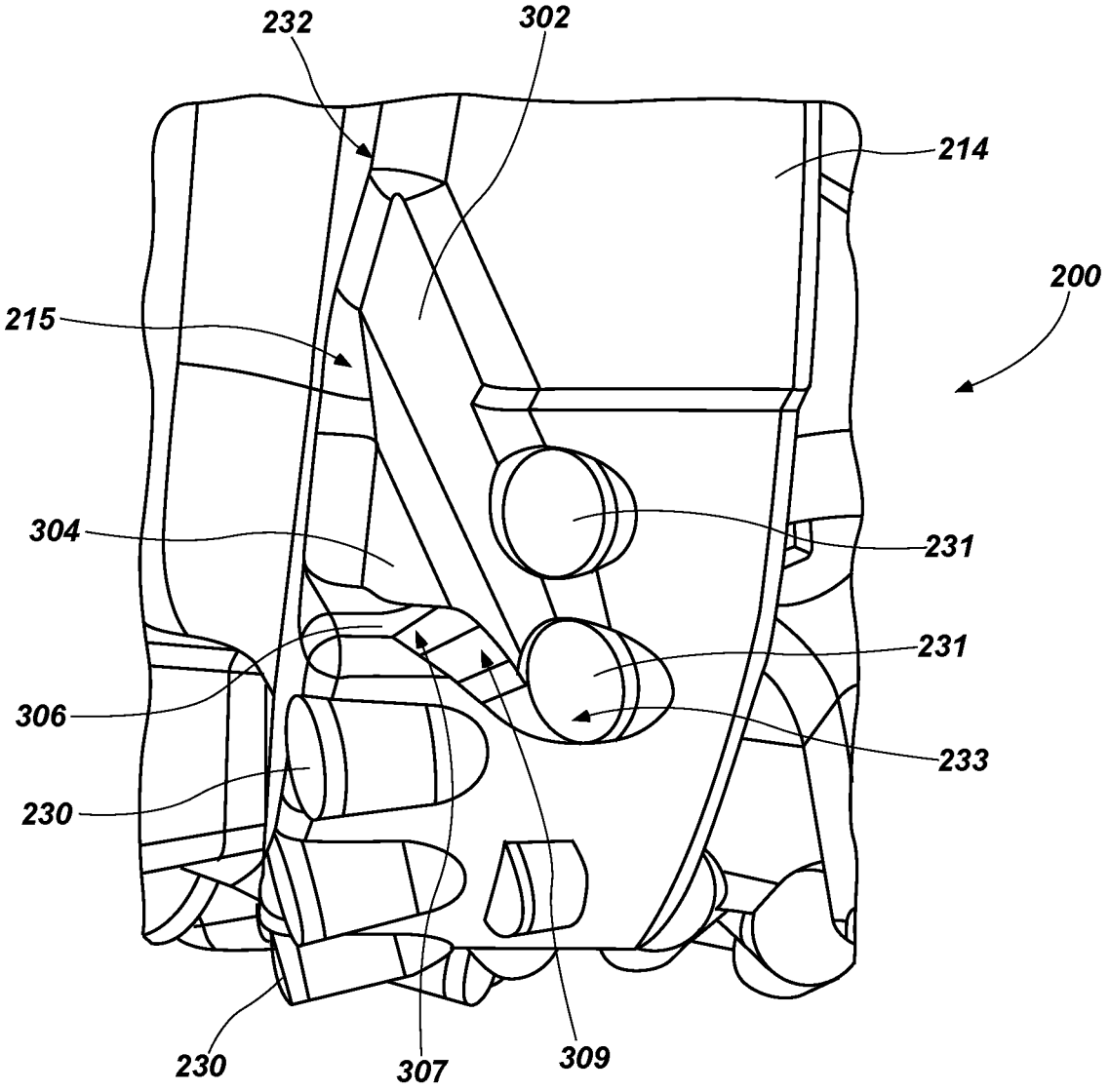
FIG. 3A is a partial perspective view of a blade of an earth-boring tool having a pocket formed therein according to one or more embodiments of the present disclosure.

FIG. 3A is a perspective view of a pocket 215 formed within a blade 214 of an earth-boring tool 200 according to one or more embodiments of the present disclosure. FIG. 3B shows a simplified representation of a profile 350 of a blade 214 of an earth-boring tool 200 (FIG. 2A) according to an embodiment of the present disclosure. Referring to FIGS. 3A and 3B together, in some embodiments, the pocket 215 may extend angularly into the blade 214 from rotationally leading face 232 of the blade 214 within a shoulder region 352 or a shoulder region 352 and gage region 354 of the blade 214. For example, in some embodiments, the pocket 215 may be formed entirely within the shoulder region 352 of the blade 214. As another example, the pocket 215 may be formed within the shoulder region 352 and the gage region 354 of the blade 214. In yet further embodiments, portions of the pocket 215 may be formed within the shoulder region 352, gage region 354, and nose region 356 of the blade 214.

As used herein, the shoulder region 352 of the blade 214 may include a portion of the blade 214 located within an angle β defined between a horizontal axis extending through an interface of the gage region 354 and the shoulder region 352 and an interface between the shoulder region 352 and a nose region 356 of the blade 214 and about an intersection of the horizontal axis and the center longitudinal axis 205 of the earth-boring tool 200. In some embodiments, the angle β may be within a range of about 5° and about 25°. For instance, the angle β may be about 15°.

Figure 3B:
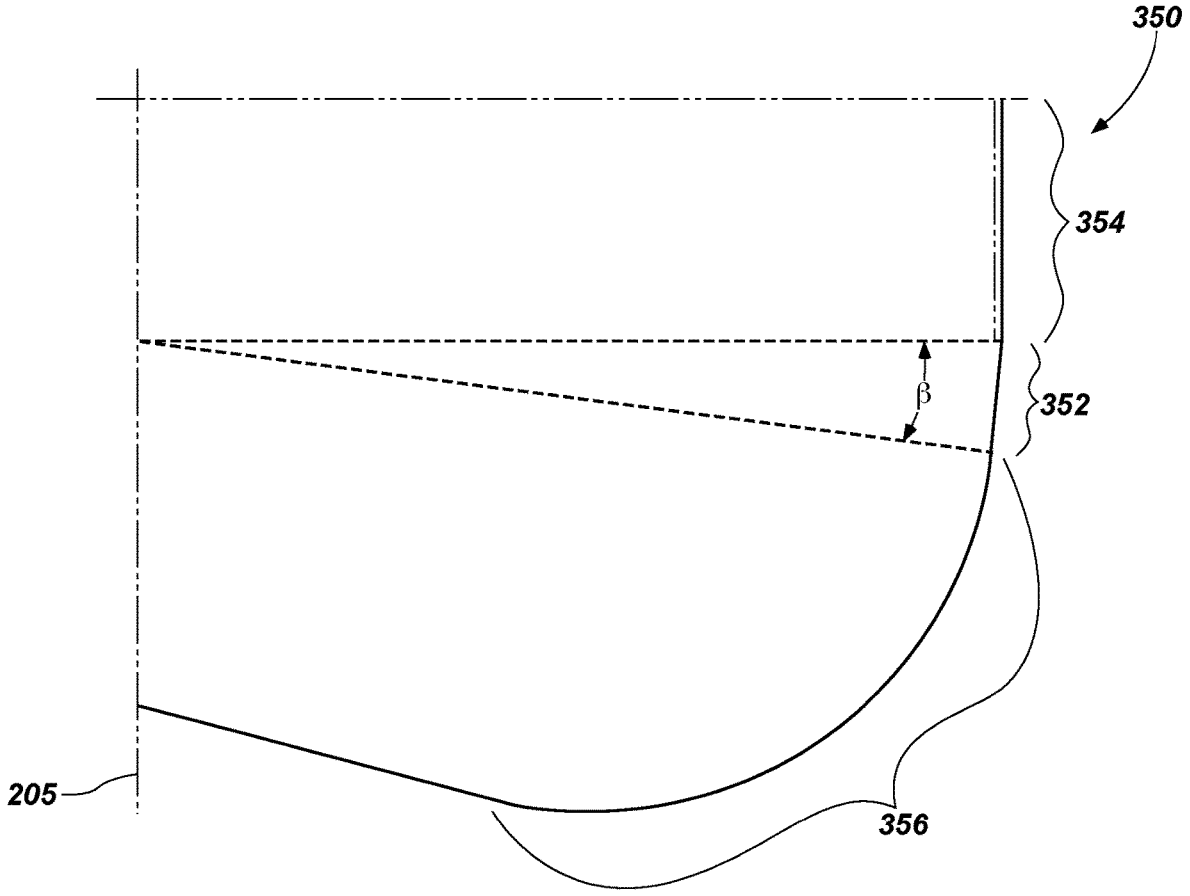
FIG. 3B is a schematic view of a profile of a blade of an earth-boring tool according to one or more embodiments of the present disclosure.

Referring still to FIGS. 3A and 3B, the pocket 215 may extend angularly into the blade 214 in a direction opposite to a rotational direction of the earth-boring tool 200. Furthermore, the pocket 215 may extend radially inward (e.g., toward a center longitudinal axis 205 of the earth-boring tool 200) from a radially outermost surface 303 of the blade 214 within the shoulder region 352 or a shoulder region 352 and gage region 354 of the blade 214.

In some embodiments, the pocket 215 may include a back surface 302, a side surface 304, and a lower surface 306. For instance, the pocket 215 may extend from the rotationally leading face 232 of the blade 214 and may terminate angularly at the back surface 302 of the pocket 215. For example, the back surface 302 may intersect the rotationally leading face 232 of the blade 214 and may extend from the rotationally leading face 232 of the blade 214. Additionally, the back surface 302 may form an obtuse angle with the rotationally leading face 232 of the blade 214. Furthermore, the pocket 215 may extend radially inward from the radially outermost surface 303 of the blade 214 and may terminate radially at the side surface 304.

In one or more embodiments, the side surface 304 may include a single side surface extending from the rotationally leading face 232 of the blade 214 to the back surface 302 of the pocket 215. The lower surface 306 may also extend from the rotationally leading face 232 of the blade 214 and may terminate angularly at the back surface 302 of the pocket 215. In some embodiments, the side surface 304 may be at least substantially planar, and the back surface 302 may be at least substantially planar. Additionally, the lower surface 306 of the pocket 215 may have an at least substantially planar portion 307 and one or more curved portions 309. The one or more curved portions 309 of the lower surface 306 may be proximate (e.g., adjacent) to the back surface 302 of the pocket 215. As is discussed in greater detail below, the one or more curved portions 309 of the lower surface 306 may enable the pocket 215 to extend at least partially behind one or more cutting elements 230 of the first plurality of cutting elements 230 disposed at leading face 232 of the blade 214 relative to a direction of rotation of the earth-boring tool 200. In some embodiments, the back surface 302, the side surface 304, and the lower surface 306 may define a general right triangle shape. In other words, the pocket 215 may have a general right triangle shape.

In some embodiments, the side surface 304 and the lower surface 306 may define an angle therebetween within the range of about 90° and about 130°. For instance, the side surface 304 and the lower surface 306 may define an angle of about 116° therebetween. Regardless, the back surface 302, the side surface 304, and the lower surface 306 of the pocket 215 may be exposed to an environment surrounding the earth-boring tool 200. In other words, the pocket 215 may be open. In one or more embodiments, the side surface 304 may define an angle with the rotationally leading face 232 of the blade 214 of about 60° to about 120°. For example, the side surface 304 may define an angle with the rotationally leading face 232 of the blade 214 of about 96°. Moreover, a radially innermost edge of the back surface 302 may define an angle with the rotationally leading face 232 of the blade 214 of about 20° to about 40°. For example, the radially innermost edge of the back surface 302 may define an angle with the rotationally leading face 232 of the blade 214 of about 29°.

Additionally, a radially outermost edge of the back surface 302 may define an angle with the rotationally leading face 232 of the blade 214 of about 20° to about 40°. For instance, the radially innermost edge of the back surface 302 may define an angle with the rotationally leading face 232 of the blade 214 of about 28°. Furthermore, the radially innermost edge of the back surface 302 may define an angle with a horizontal plane to which the center longitudinal axis 205 of the earth-boring tool 200 is normal of about 100° to about 120°. As a non-limiting example, the radially innermost edge of the back surface 302 may define an angle with a horizontal plane of about 108°. Also, the radially outermost edge of the back surface 302 may define an angle with a horizontal plane of about 100° to about 120°. For example, the radially outermost edge of the back surface 302 may define an angle with a horizontal plane of about 108°.

In some embodiments, the lower surface 306 of the pocket 215 may define an angle with the rotationally leading face 232 of the blade 214 of about 60° to about 120°. For example, the side surface 304 may define an angle with the rotationally leading face 232 of the blade 214 of about 96°. Additionally, the back surface 302 of the pocket 215 and the side surface 304 may define an angle within a range of about 90° to about 120°. For example, the back surface 302 of the pocket 215 and the side surface 304 may define an angle of about 105°.

In one or more embodiments, the pocket 215 may extend from the shoulder region 352 and partially into the gage region 354 of the blade 214. In some embodiments, between about 40% and about 80% of a total height of the pocket 215 (e.g., a height of the pocket 215 along the center longitudinal axis 205 of the pocket 215) may extend into the gage region 354 of the blade 214. For example, about 60% of the total height of the pocket 215 may extend into the gage region 354 of the blade 214. As used herein, a "height" of the pocket 215 may refer to a distance between a planar portion of the lower surface at an intersection of the lower surface with the leading face 232 of the blade 214 and an intersection of the back surface 302 with in the leading face 232 of the blade 214. In one or more embodiments, the pocket 215 may have a height between about 1.00 inch and about 3.00 inches. Accordingly, between about 0.4 inches and about 2.40 inches of the pocket 215 may extend into the gage region 354. For instance, between about 0.6 inches and about 1.80 inches of the pocket 215 may extend into the gage region 354. In some embodiments, only the back surface 302 and the side surface 304 of the pocket 215 may extend into the gage region 354 of the blade 214.

In some embodiments, the pocket 215 may have a maximum width at a base of the pocket 215 and along the lower surface 306 of the pocket 215. For instance, the width of the pocket 215 may increase gradually from a zero width at a top of the pocket 215 to the maximum width at the base of the pocket 215. In some embodiments, at the base of the pocket 215, the pocket 215 may extend angularly (i.e., angularly about a longitudinal axis) for about 15° to about 25° about the center longitudinal axis 205 (FIG. 2B) of the earth-boring tool 200. In other words, an angle between a plane extending from the center longitudinal axis 205 (FIG. 2B) of the earth-boring tool 200 and along the rotationally leading face 232 of the blade 214, and a plane extending from the center longitudinal axis 205 (FIG. 2B) of the earth-boring tool 200 to the interface between the side surface 304 and the back surface 302 of the pocket 215 at the base of the pocket 215 may be about 15° to about 25°. Put yet another way, the interface of the side surface 304 and the back surface 302 at the base of the pocket 215 may trail the rotationally leading face 232 of the blade 214 along a direction of rotation of the earth-boring tool 200 by about 15° to about 25°. As will be understood by one of ordinary skill in the art, an amount by which the pocket 215 extends angularly at the base of the pocket 215 may vary based on bit size, cutter size, blade 214 thickness, etc.

In some embodiments, as noted above, a portion of the pocket 215 may extend at least partially behind at least one cutting element 230 of the first plurality of cutting elements 230 disposed along the rotationally leading face 232 of the blade 214 along a rotational pathway defined by the at least one cutting element 230 during a rotation of the earth-boring tool 200. Furthermore, as discussed above in regard to FIGS. 2A and 2B, the pocket 215 may house a second plurality of cutting elements 231. Additionally, a rotational pathway (defined by a rotation of the earth-boring tool 200) of at least one cutting element 231 of the second plurality of cutting elements 231 within the pocket 215 may at least partially overlap a rotational pathway of a cutting element 230 of the first plurality of cutting elements 230 disposed at the rotationally leading face 232 of the blade 214 in which the pocket 215 is defined. For instance, the rotational pathway of at least one cutting element 231 may overlap the rotational pathway of the cutting element 230 by any of the amounts described above. Put another way, within a cutting profile of the earth-boring tool 200 defined by the first and second pluralities of cutting elements 230, 231 during a full rotation of the earth-boring tool 200, at least one cutting element 231 housed by the pocket 215 may at least partially overlap with a cutting element 230 disposed at the rotationally leading face 232 of the blade 214 within which the pocket 215 is formed. Cutting elements 231 of the second plurality of cutting elements 231 that overlap with cutting elements of the first plurality of cutting elements 230 are referred to hereinafter as "shadow cutting elements 233." In some embodiments, the earth-boring tool 200 may include two or more shadow cutting elements 233 within a single pocket 215 of a single blade 214.

In some embodiments, at least one cutting element 231 of the second plurality of cutting elements 231 disposed within the pocket 215 may be disposed within the shoulder region 352 of the blade 214, and at least one other cutting element 231 of the second plurality of cutting elements 231 may be disposed within a gage region of the blade 214. In other embodiments, all of the cutting elements 231 of the second plurality of cutting elements 231 may be disposed within the shoulder region 352 of the blade 214. Moreover, in one or more embodiments, cutting faces of the second plurality of cutting elements 231 may be angled relative to the back surface 302 of the pocket 215. For example, the back surface 302 of the pocket 215 may define an angle with the cutting faces of the second plurality of cutting elements 231 within a range of about 5° and about 15°. In some embodiments, the back surface 302 of the pocket 215 may define an angle of about 10°. Furthermore, an orientation of the back surface 302 (e.g., an angle of the back surface 302 relative to the rotationally leading face 232 of the blade 214) may be determined (e.g., formed) based on a rake of the cutting faces of the second plurality of cutting elements 231 housed within the pocket 215. In some embodiments, the second plurality of cutting elements 231 within the pocket 215 may have a back rake within a range of about 30° to about 50°. For example, the second plurality of cutting elements 231 within the pocket 215 may have a back rake of about 40°. The first plurality of cutting elements 230 disposed along the rotationally leading face 232 of the blade 214 may have a back rake within a range of about 25° to about 35°. For instance, the first plurality of cutting elements 230 disposed along the rotationally leading face 232 of the blade 214 may have a back rake of about 30°.

Referring to FIGS. 2A-3B together, in one or more embodiments, the earth-boring tool 200 may include a pocket 215 (as described above) in each of a plurality of blades 214 of the earth-boring tool 200. Additionally, in some embodiments, the earth-boring tool 200 may include pockets 215 formed in two or more blades 214. In some instances, the earth-boring tool 200 may include pockets 215 formed in two, three, four, five, or six consecutive blades 214. In further embodiments, the earth-boring tool 200 may include pockets 215 formed in three consecutive blades 214 of six total blades 214 of the earth-boring tool 200. For instance, the earth-boring tool 200 may include pockets 215 formed in three consecutive (side-by-side) blades 214 having the uppermost (e.g., axially uppermost) cutting elements 230 of the first plurality of cutting elements 230 disposed within shoulder regions of the blades 214. In additional embodiments, the earth-boring tool 200 may include pockets 215 formed in alternating blades 214 (e.g., every other blade 214) of the earth-boring tool 200. As is discussed in greater detail below in regard to FIGS. 5 and 6, the pockets 215 may enable an earth-boring tool 200 to include an increased number of cutting elements within the shoulder region 352 of the earth-boring tool 200 while maintaining a relatively short cutting profile height to maintain stability and directional responsiveness in directional drilling without sacrificing durability.

In embodiments including a plurality of pockets 215 (e.g., pockets formed in a plurality of different blades 214), each pocket 215 of the plurality of pockets 215 may have a different height relative to the other pockets 215 of the plurality of pockets 215. For instance, a height of a given pocket 215 of the plurality of pockets 215 may be determined based on locations and orientations of cutting elements 231 of the second plurality of cutting elements 231 within the given pocket 215. For example, an intersection of the back surface 302 of the given pocket 215 and the leading face 232 of a respective blade 214 may be defined based on the locations and orientations of the cutting elements 231 within the given pocket 215. For example, as discussed above, an angle of the back surface 302 and, as a result, the intersection of the back surface 302 and the leading face 232, is determined based on the orientations of the cutting faces of the cutting elements 231. In alternative embodiments, two or more of the plurality of pockets 215 may have a same height. In additional embodiments, all of the plurality of pockets 215 may have a same height.

In view of the foregoing and the following, the height of the pocket 215 (e.g., location of the intersection of the back surface 302 of the pocket 215 with the leading face 232 of the blade 214) and an angle of the back surface 302 formed with the leading face 232 of the blade 214 may enable the pocket 215 to "self-clear." For instance, during a typical rotation of the earth-boring tool 200, cuttings (e.g., debris) producing from the earth-boring tool 200 and drilling operations may naturally enter the pocket 215, and the angle of the back surface 302 and location of the intersection of the back surface 302 of the pocket 215 with the leading face 232 of the blade 214 may cause drilling fluids, generally referred to in the industry as "mud" to naturally enter the pocket 215 and push out cuttings and other debris within the pocket 215. Furthermore, as is discussed in greater detail below in regard to FIG. 4, nozzles may be oriented proximate to the pockets 215 to assist in keeping the pockets 215 clear from debris and functioning properly.

Figure 4:
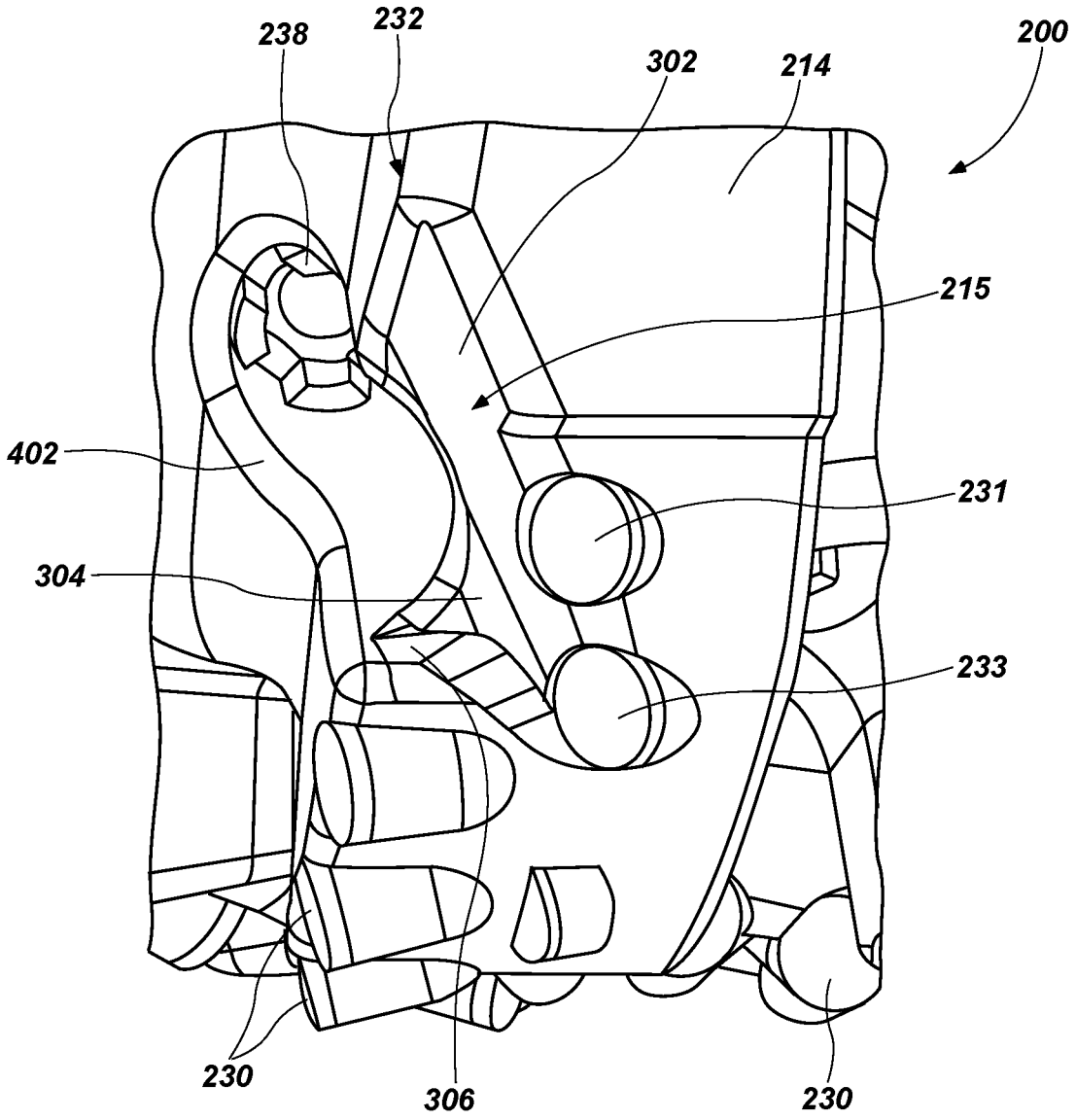
FIG. 4 is a partial perspective view of a blade of an earth-boring tool having a pocket formed therein according to one or more embodiments of the present disclosure.

FIG. 4 shows a pocket 215 formed in a blade 214 of an earth-boring tool 200 according to another embodiment of the present disclosure. For example, the pocket 215 may include any of the pockets 215 described above in regard to FIGS. 2A-3B; however, the pocket 215 may include at least one port 402 extending through the bit body and intersecting at least a portion of the pocket 215, and a nozzle 238 may be may be secured within the at least one port 402 for enhancing direction of fluid flow and controlling flow rate of the drilling fluid. In some embodiments, the at least one port 402 may only intersect with the side surface 304 of the pocket 215. In additional embodiments, the at least one port 402 may only intersect with the side surface 304 and the lower surface 306 of the pocket 215. In yet further embodiments, the at least one port 402 may intersect with each of the back surface 302, the side surface 304, and the lower surface 306 of the pocket 215.

In view of the foregoing, having a port 402 extending through the bit body and intersecting the pocket 215 of the blade 214 may improve hydraulics and cooling of the earth-boring tool 200 within the shoulder regions of the blades 214 of the earth-boring tool 200. Having improved hydraulics and cooling within the shoulder regions of the blades 214 may improve durability of the cutting elements in the shoulder regions of the blades 214, which may lead to increased lifespans and costs savings.

Figure 5:
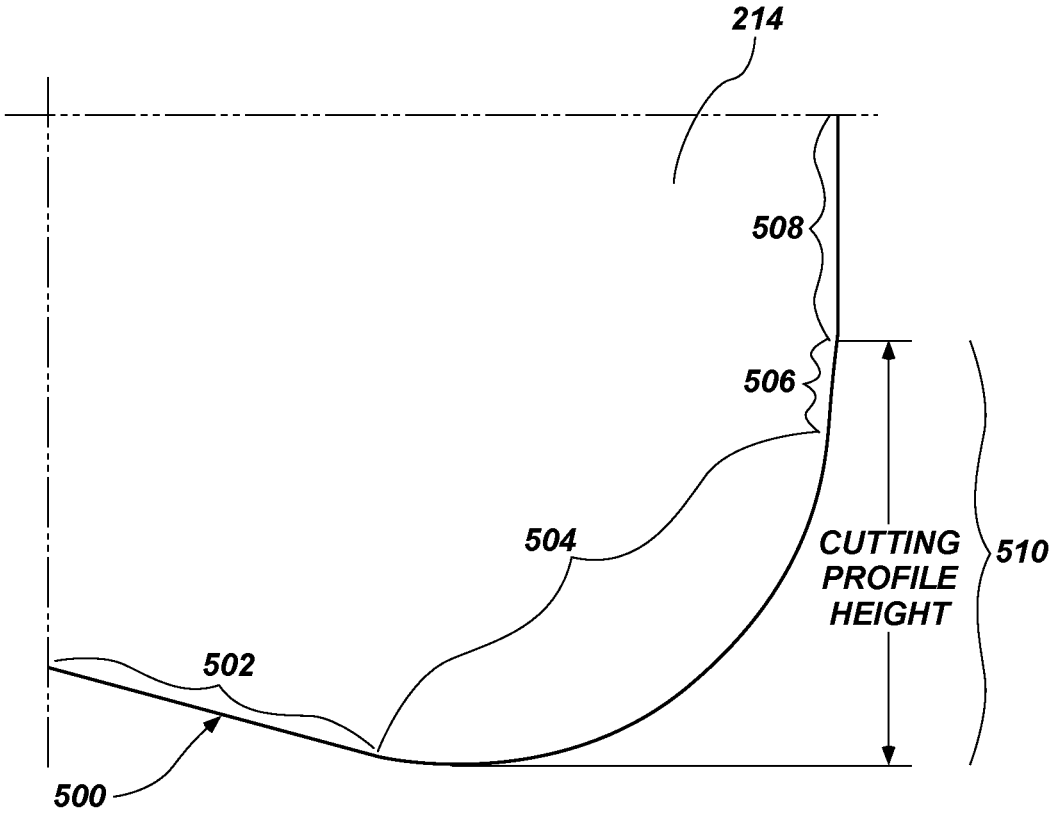
FIG. 5 is partial schematic view of a blade profile according to an embodiment of the present disclosure.

FIG. 5 shows a simplified schematic representation of a portion of a profile 500 of a blade 214 of an earth-boring tool 200 (FIG. 2A) according to an embodiment of the present disclosure. The profile 500 may include a cone line 502, a nose arc 504, a shoulder arc 506, and a gage line 508. As will be understood by one of ordinary skill in the art, the cone line 502 may extend through a cone region of the blade 214, the nose arc 504 may extend throughout a nose region 356 of the blade 214, the shoulder arc 506 may extend through a shoulder region 352 of the blade 214, and the gage line 508 may extend along a gage region of the blade 214.

As is shown in FIG. 5, a cutting profile height of a cutting profile 510 defined by the cutting elements of the blades 214 of the earth-boring tool 200 may include an axial length (e.g., a length along an axial length of the earth-boring tool 200) between a bottom of the nose arc 504 of the blade 214 and a bottom of the gage line 508 (i.e., an interface of the shoulder arc 506 and the gage line 508) of the blade 214.

In some embodiments, a ratio of a cutting profile height of the earth-boring tool 200 (FIG. 2B) to a drill bit diameter of the earth-boring tool 200 (FIG. 2B) may be within a range of about 0.15 and about 0.35. In some embodiments, a ratio of a cutting profile height of the earth-boring tool 200 to a diameter of the earth boring tool is greater than about 0.15. For instance, the ratio may be within a range of about 0.15 and 0.25. As a non-limiting example, the ratio may be about 0.18. As a non-limiting example, in some embodiments, the cutting profile height may be about 1.56 inches and the drill bit diameter may be about 8.5 inches.

Figure 6:
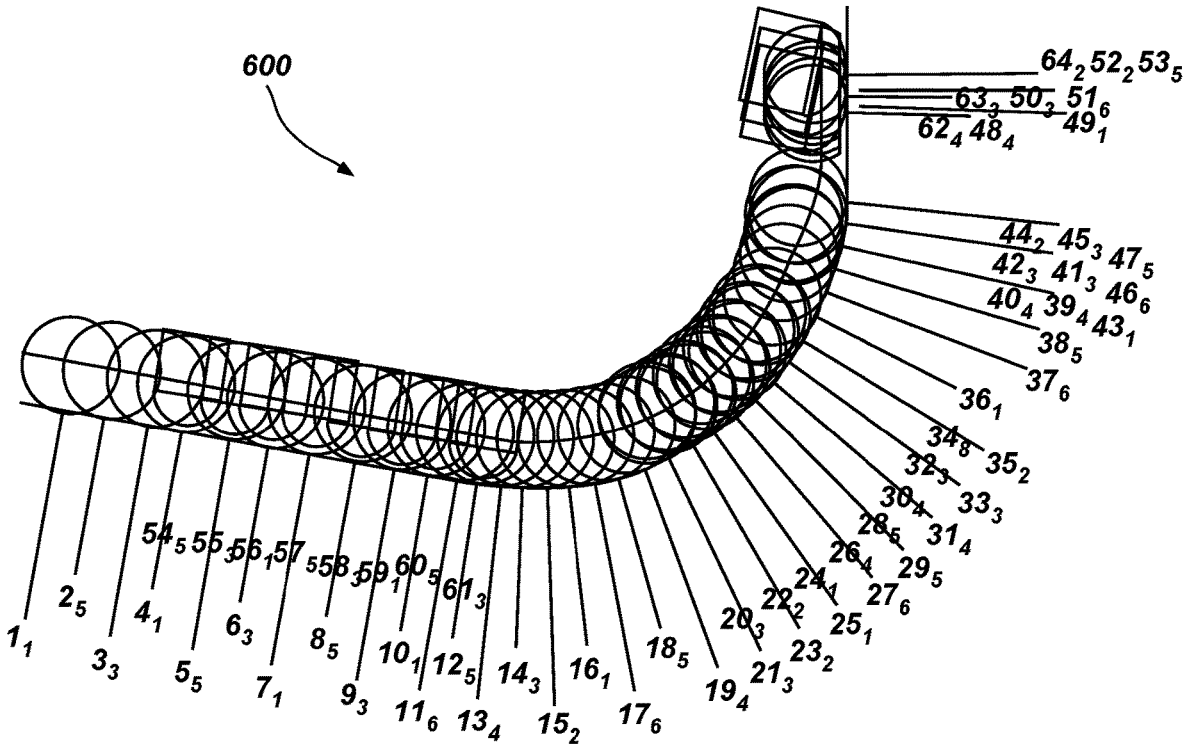
FIG. 6 is a schematic view of a cutting profile defined by cutting elements of an earth-boring tool according to one or more embodiments of the present disclosure.

FIG. 6 shows a schematic view of a cutting profile 600 defined by the first and second pluralities of cutting elements 230, 231 (FIG. 2A) of the plurality of blades 214 (FIG. 2A) of the earth-boring tool 200 (FIG. 2A) according to one or more embodiments of the present disclosure. Referring to FIGS. 2B and 6 together, for purposes of the present disclosure, the plurality of blades 214 of the earth-boring tool 200 depicted in FIG. 2B will be numbered and described with references to those numbers in order to facilitate description of certain aspects of the earth-boring tool 200. For example, the earth-boring tool 200 may include six numbered blades 214.

With reference to FIG. 2B, blade No. 1 may be oriented in a generally 3:00 o'clock position. Moving clockwise around the earth-boring tool 200, blade No. 2 may include a next rotationally adjacent blade 214 to blade No. 1. Additionally, blade No. 3 may include a next rotationally adjacent blade 214 in the clockwise direction. Moreover, blade No. 4 may include a next rotationally adjacent blade 214 in the clockwise direction. Likewise, blade No. 5 may include a next rotationally adjacent blade 214 in the clockwise direction. Blade No. 6 may include a next rotationally adjacent blade 214 in the clockwise direction.

As is represented in FIGS. 2B, 3A, 3B, and 6, the shadow cutting elements 233 may be disposed within pockets 215 of three blades 214 of a total of six blades 214 of the earth-boring tool 200. Furthermore, in some embodiments, the shadow cutting elements 233 may be disposed in an opposing kerfing configuration (e.g., in same radial position as a cutting element on an opposite blade 214). For instance, as shown in FIG. 6 and with reference to FIG. 2B, shadow cutting element No. 47 may be disposed within a pocket 215 of blade No. 5 and may be disposed in an opposing kerfing configuration with cutting element No. 45 of the shoulder region 352 of blade No. 2. Furthermore, shadow cutting element No. 46 may be disposed within a pocket 215 of blade No. 6 and may be disposed in an opposing kerfing configuration with cutting element No. 41 of the shoulder region 352 of blade No. 3. Moreover, shadow cutting element No. 43 may be disposed within a pocket 215 of blade No. 1 and may be disposed in an opposing kerfing configuration with cutting element No. 39 of the shoulder region 352 of blade No. 4. In alternative embodiments, the shadow cutting elements 233 may be disposed in non-opposing kerfing configurations. Moreover, the shadow cutting elements 233 may be ground or unground as will be understood by one of ordinary skill in the art.

In view of the foregoing, the pocket 215, as described herein, provides advantages over conventional earth-boring tools. For example, in comparison to earth-boring tools having longer (e.g., taller) cutting profiles, the earth-boring tool 200 of the present disclosure may increase shoulder durability by increasing cutting element density without sacrificing directional control, build-up rate potential, and vibration levels. For instance, the earth-boring tool 200 of the present disclosure increases stability and directional responsiveness of relatively shorter profiled earth-boring tools while improving shoulder region durability. Furthermore, the earth-boring tool 200 of the present disclosure increases drilling efficiency when drilling on an adjustable kick off sub ("AKO") by decreasing bit body rubbing. For example, the earth-boring tool 200 of the present disclosure enables the earth-boring tool 200 to drill at a higher rate of penetration ('ROP") in a lateral wall.

Furthermore, the earth-boring tool 200 of the present disclosure may include a higher number of face cutting elements per unit of cutting profile height, as defined above. As used herein, the term "face cutting elements" refers to cutting elements that are disposed on a leading edge of a blade 214 and/or pocket 215 and not to cutting elements disposed within a gage region of the blade 214. For instance, the earth-boring tool 200 of the present disclosure may include between about 18 and 20 face cutting elements per inch of cutting profile height in comparison to conventional earth-boring tools with the same profile without shadow cutting elements, which include about 15 cutting elements per inch of cutting profile height. For instance, the earth-boring tool 200 of the present disclosure may include about 18 cutting elements per inch of cutting profile height.

As non-limiting examples, with reference to a drill bit having an 8.75 inch diameter and having six blades, the earth-boring tool 200 of the present disclosure may include between about 33 and 37 face cutting elements for cutting elements having a diameters of 0.375 inch. Additionally, the earth-boring tool 200 of the present disclosure may include between about 28 and 32 face cutting elements for cutting elements having a diameters of 0.500 inch. Moreover, the earth-boring tool 200 of the present disclosure may include between about 26 and 30 face cutting elements for cutting elements having a diameters of 0.625 inch. Furthermore, the earth-boring tool 200 of the present disclosure may include between about 21 and 25 face cutting elements for cutting elements having a diameters of 0.750 inch. As will be understood by one of ordinary skill in the art, the number of cutting elements may vary depending on cutting element size, bit size, etc. Furthermore, as will be understood by one of ordinary skill in the art, the pockets 215 described herein may enable an earth-boring tool 200 to have a higher cutting element density in comparison to conventional earth-boring tools, which leads to improved durability without sacrificing stability or directional responsiveness.

Figure 7:
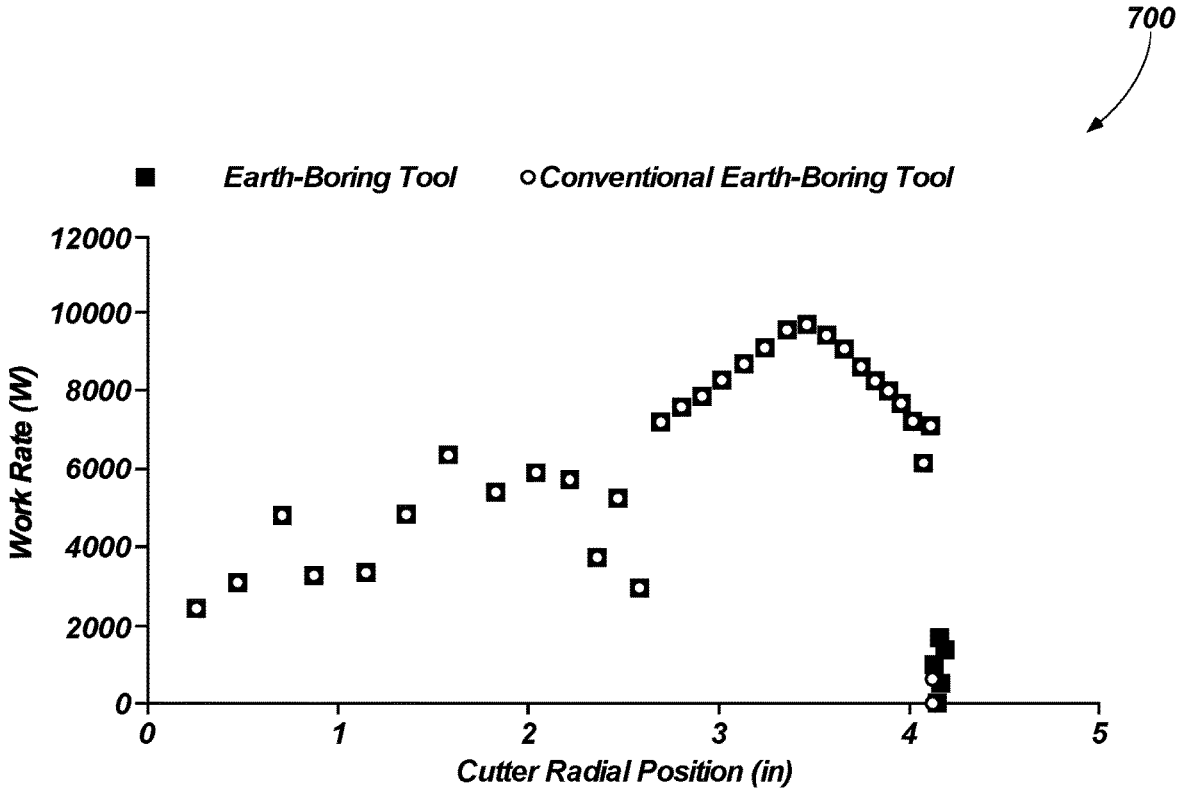
FIG. 7 is a graph showing workrates of cutting elements of an earth-boring tool according to one or more embodiments of the present disclosure.

FIG. 7 is a graph 700 showing workrates (W) of cutting elements of an earth-boring tool (e.g., earth-boring tool 200) having a relatively shorter cutting profile and shadow cutting elements 233 (FIG. 2A) in comparison to workrates of cutting elements of conventional earth-boring tools having the relatively shorter cutting profiles without shadow cutting elements 233 (FIG. 2A). As shown in the graph 700, the workrates of correlating cutting elements are essentially the same, except that the earth-boring tool of the present disclosure has more face cutting elements actively engaging a formation. Furthermore, it should be noted that the earth-boring tool of the present disclosure performs essentially the same as earth-boring tools having taller cutting profiles in terms of workrate but has improved stability, improved directional responsiveness, reduced vibrations, and better build-up rate potential. Accordingly, the earth-boring tool of the present disclosure may lead to cost savings and may provide a more durable earth-boring tool.

Referring to FIGS. 2A and 7 together, in some embodiments, the earth-boring tool 200 may include four cutting elements between 0 and 1 inch from a center longitudinal axis 205 of the earth-boring along a radius of the earth-boring tool. Additionally, the earth-boring tool 200 may include four face cutting elements between 1 inch and 2 inches from the center longitudinal axis 205 of the earth-boring along the radius of the earth-boring tool performing work drilling on-center in new state. Moreover, the earth-boring tool 200 may include seven cutting elements between 2 inches and 3 inches from the center longitudinal axis 205 of the earth-boring along the radius of the earth-boring tool performing work drilling on-center in new state. Furthermore, the earth-boring tool 200 may include twelve cutting elements between 3 inches and 4 inches from the center longitudinal axis 205 of the earth-boring along the radius of the earth-boring tool performing work drilling on-center in new state. Also, the earth-boring tool may include about 7 cutting elements between 4 inches and 4.25 inches from the center longitudinal axis 205 of the earth-boring along the radius of the earth-boring tool performing work drilling on-center in new state.

The disclosure further includes the following embodiments:

Embodiment 1

An earth-boring tool, comprising: a body including a plurality of blades, each blade of the plurality of blades extending axially and radially relative to a center longitudinal axis of the body, at least one blade of the plurality of blades having a pocket extending into the at least one blade from a rotationally leading face of the at least one blade in at least a shoulder region of the at least one blade, the pocket comprising: an at least substantially planar back surface forming an obtuse angle with the leading face of the at least one blade; a side surface extending from the rotationally leading face of the at least one blade to the back surface; and a lower surface extending from the rotationally leading face of the at least one blade to the back surface; a first plurality of cutting elements secured along rotationally leading faces of the plurality of blades; and a second plurality of cutting elements secured to the at least one blade of the plurality of blades proximate a back surface of the pocket.

Embodiment 2

The earth-boring tool of embodiment 1, wherein a ratio of a cutting profile height of the earth-boring tool and a diameter of the earth boring tool is greater than about 0.15.

Embodiment 3

The earth-boring tool of embodiments 1 and 2, wherein the leading face of the at least one blade, the back surface of the pocket, the side surface of the pocket, and the lower surface of the pocket form a general right triangle shape.

Embodiment 4

The earth-boring tool of embodiments 1-3, wherein cutting faces of the second plurality of cutting elements form an angle with the back surface of the pocket within a range of about 5° and about 15°.

Embodiment 5

The earth-boring tool of embodiments 1-4, wherein the at least one blade of the plurality of blades comprises two or more blades, and the two or more blades are either located side-by-side, or alternating with other blades of the plurality of blades lacking a pocket.

Embodiment 6

The earth-boring tool of embodiments 1-5, wherein a rotational pathway of at least one cutting element of the second plurality of cutting elements defined by a full rotation of the earth-boring tool at least partially overlaps with another rotational pathway of at least one cutting element of the first plurality of cutting elements.

Embodiment 7

The earth-boring tool of embodiments 1-6, wherein at least one cutting element of the second plurality of cutting elements is oriented in an opposing kerfing configuration with at least one cutting element disposed within a shoulder region of an opposite blade of the earth-boring tool.

Embodiment 8

The earth-boring tool of embodiments 1-7, wherein a width of the pocket along a direction of rotation of the earth-boring tool increases at least substantially linearly from about zero at a top of the pocket to a maximum width at a base of the pocket at the lower surface of the pocket.

Embodiment 9

An earth-boring tool, comprising: a body including a plurality of blades, each blade of the plurality of blades extending axially and radially relative to a center longitudinal axis of the body, at least one blade of the plurality of blades having a pocket extending into the at least one blade from a rotationally leading face of the at least one blade in a shoulder region and gage region of the at least one blade, wherein between about 40% and about 80% of a height of the pocket is formed within the gage region of the at least one blade; a first plurality of cutting elements secured along rotationally leading faces of the plurality of blades; and a second plurality of cutting elements secured to the at least one blade of the plurality of blades proximate a back surface of the at least one pocket.

Embodiment 10

The earth-boring tool of embodiment 9, wherein a rotational pathway of at least one cutting element of the second plurality of cutting elements defined by a full rotation of the earth-boring tool at least partially overlaps with another rotational pathway of at least one cutting element of the first plurality of cutting elements.

Embodiment 11

The earth-boring tool of embodiment 10, wherein the at least one cutting element of the second plurality of cutting elements and the at least one cutting element of the first plurality of cutting elements are disposed on the same blade of the plurality of blades.

Embodiment 12

The earth-boring tool of embodiments 9-11, wherein a ratio of a cutting profile height of the earth-boring tool and a diameter of the earth-boring tool is greater than about 0.15.

Embodiment 13

The earth-boring tool of embodiment 12, wherein the pocket comprises: an at least substantially planar back surface forming an obtuse angle with the leading face of the at least one blade; a side surface extending from the rotationally leading face of the at least one blade to the back surface; and a lower surface extending from the rotationally leading face of the at least one blade to the back surface.

Embodiment 14

The earth-boring tool of embodiments 9-13, wherein the lower surface of the pocket forms a maximum width of the pocket, and wherein the back surface of the pockets extends from the lower surface to the leading face of the at least one blade.

Embodiment 15

The earth-boring tool of embodiments 9-14, further comprising: a port extending through the bit body and intersecting the pocket; and a nozzle secured within the port.

Embodiment 16

The earth-boring tool of embodiments 9-15, wherein about 60% of a height of the pocket is formed within the gage region of the at least one blade.

Embodiment 17

The earth-boring tool of embodiments 9-16, wherein multiple blades of the plurality of blades each comprise a pocket, and wherein a height of each pocket of the multiple blades differs in height from other pockets of the multiple blades.

Embodiment 18

A method of forming an earth-boring tool, comprising: forming a body of an earth-boring tool including a plurality of blades; forming at least one pocket within a shoulder region and a gage region of at least one blade of the plurality of blades, comprising: forming an at least substantially planar back surface of the at least one pocket, the at least substantially planar back surface forming an obtuse angle with a leading face of the at least one blade; forming a side surface of the at least one pocket to extend from the rotationally leading face of the at least one blade to the back surface of the at least one pocket; and forming a lower surface of the at least one pocket to extend from the rotationally leading face of the at least one blade to the back surface of the at least one pocket; wherein between about 40% and about 80% of a height of the at least one pocket is formed within the gage region of the at least one blade, securing a first plurality of cutting elements along rotationally leading faces of the plurality of blades; and securing a second plurality of cutting elements to the at least one blade proximate a back surface of the at least one pocket.

Embodiment 19

The method of embodiment 18, wherein forming the body of the earth-boring tool further comprises forming the body to have a cutting profile height, wherein a ratio of the cutting profile height of the earth-boring tool and a diameter of the earth boring tool is greater than about 0.15.

Embodiment 20

The method of embodiment 18 and 19, wherein securing a first plurality of cutting elements and a second plurality of cutting elements further comprises locating at least one cutting element of the second plurality of cutting elements and at least one cutting element of the first plurality of cutting elements such that a rotational pathway of the at least one cutting element of the second plurality of cutting elements defined by a full rotation of the earth-boring tool at least partially overlaps with another rotational pathway of the at least one cutting element of the first plurality of cutting elements.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:

a body including a plurality of blades, each blade of the plurality of blades extending axially and radially relative to a center longitudinal axis of the body, at least one blade of the plurality of blades having a pocket extending into the at least one blade from a rotationally leading face of the at least one blade in at least a shoulder region of the at least one blade, the pocket defined by:

an at least substantially planar back surface formed in the at least one blade forming an obtuse angle with the rotationally leading face of the at least one blade;

a side surface formed in the at least one blade extending from the rotationally leading face of the at least one blade to the at least substantially planar back surface; and a lower surface formed in the at least one blade extending from the rotationally leading face of the at least one blade to the at least substantially planar back surface;

a first plurality of cutting elements secured along rotationally leading faces of the plurality of blades; and a second plurality of cutting elements secured to the at least one blade of the plurality of blades proximate a back surface of the pocket.

2. The earth-boring tool of claim 1, wherein a ratio of a cutting profile height of the earth-boring tool to a diameter of the earth-boring tool is greater than about 0.15.

3. The earth-boring tool of claim 1, wherein the rotationally leading face of the at least one blade, the back surface of the pocket, the side surface of the pocket, and the lower surface of the pocket form a general right triangle shape.

4. The earth-boring tool of claim 1, wherein the at least one blade of the plurality of blades comprises two or more blades, and the two or more blades are located side-by-side.

5. The earth-boring tool of claim 1, wherein the at least one blade of the plurality of blades comprises two or more blades, and wherein the body includes an additional blade lacking a pocket disposed between two blades of the two or more blades.

6. The earth-boring tool of claim 1, wherein a rotational pathway of at least one cutting element of the second plurality of cutting elements defined by a full rotation of the earth-boring tool at least partially overlaps with another rotational pathway of at least one cutting element of the first plurality of cutting elements.

7. The earth-boring tool of claim 1, wherein at least one cutting element of the second plurality of cutting elements is oriented in an opposing kerfing configuration with at least one cutting element disposed within a shoulder region of an opposite blade of the earth-boring tool.

8. The earth-boring tool of claim 1, wherein a width of the pocket along a direction of rotation of the earth-boring tool increases at least substantially linearly from about zero at a top of the pocket to a maximum width at a base of the pocket.

9. An earth-boring tool, comprising:

a body including a plurality of blades, each blade of the plurality of blades extending axially and radially relative to a center longitudinal axis of the body, at least one blade of the plurality of blades having a pocket extending into the at least one blade from a rotationally leading face of the at least one blade in a shoulder region and gage region of the at least one blade, wherein between about 40% and about 80% of a height of the pocket is located within the gage region of the at least one blade;

a first plurality of cutting elements secured along rotationally leading faces of the plurality of blades; and a second plurality of cutting elements secured to the at least one blade of the plurality of blades within the pocket.

10. The earth-boring tool of claim 9, wherein a rotational pathway of at least one cutting element of the second plurality of cutting elements defined by a full rotation of the earth-boring tool at least partially overlaps with another rotational pathway of at least one cutting element of the first plurality of cutting elements.

11. The earth-boring tool of claim 10, wherein the at least one cutting element of the second plurality of cutting elements and the at least one cutting element of the first plurality of cutting elements are disposed on the same blade of the plurality of blades.

12. The earth-boring tool of claim 9, wherein a ratio of a cutting profile height of the earth-boring tool to a diameter of the earth-boring tool is greater than about 0.15.

13. The earth-boring tool of claim 12, wherein the pocket is defined by:

an at least substantially planar back surface formed in the at least one blade forming an obtuse angle with the rotationally leading face of the at least one blade;

a side surface formed in the at least one blade extending from the rotationally leading face of the at least one blade to the at least substantially planar back surface; and a lower surface formed in the at least one blade extending from the rotationally leading face of the at least one blade to the at least substantially planar back surface.

14. The earth-boring tool of claim 13, wherein the lower surface forms a maximum width of the pocket, and wherein the at least substantially planar back surface extends from the lower surface to the rotationally leading face of the at least one blade.

15. The earth-boring tool of claim 9, further comprising:

a port extending through the body and intersecting the pocket; and a nozzle secured within the port.

16. The earth-boring tool of claim 9, wherein about 60% of the height of the pocket is formed within the gage region of the at least one blade.

17. The earth-boring tool of claim 9, wherein multiple blades of the plurality of blades each comprise a pocket, and wherein a height of each pocket of the multiple blades differs in height from other pockets of the multiple blades.

18. A method of forming an earth-boring tool, comprising:

forming a body of an earth-boring tool including a plurality of blades and at least one pocket within a shoulder region and a gage region of at least one blade of the plurality of blades, comprising:

forming an at least substantially planar back surface in the at least one blade of the plurality of blades to define the at least one pocket, the at least substantially planar back surface forming an obtuse angle with a leading face of the at least one blade of the plurality of blades;

forming a side surface in the at least one blade of the plurality of blades to define the at least one pocket to extend from a rotationally leading face of the at least one blade of the plurality of blades to the at least substantially planar back surface of the at least one pocket; and forming a lower surface in the at least one blade of the plurality of blades to define of the at least one pocket to extend from the rotationally leading face of the at least one blade of the plurality of blades to the at least substantially planar back surface of the at least one pocket, wherein between about 40% and about 80% of a height of the at least one pocket is located within the gage region of the at least one blade of the plurality of blades, securing a first plurality of cutting elements along rotationally leading faces of the plurality of blades; and securing a second plurality of cutting elements to the at least one blade of the plurality of blades proximate a back surface of the at least one pocket.

19. The method of claim 18, wherein forming the body of the earth-boring tool further comprises forming the body to have a cutting profile height, wherein a ratio of the cutting profile height of the earth-boring tool to a diameter of the earth-boring tool is greater than about 0.15.

20. The method of claim 18, wherein securing a first plurality of cutting elements and a second plurality of cutting elements further comprises locating at least one cutting element of the second plurality of cutting elements and at least one cutting element of the first plurality of cutting elements such that a rotational pathway of the at least one cutting element of the second plurality of cutting elements defined by a full rotation of the earth-boring tool at least partially overlaps with another rotational pathway of the at least one cutting element of the first plurality of cutting elements.

* * * * *